United States Patent [19]

Bodman

[11] 4,017,209

[45] Apr. 12, 1977

[54] TURBINE ROTOR CONSTRUCTION

[75] Inventor: Robert R. Bodman, Riviera Beach, Fla.

[73] Assignee: United Technologies Corporation, Hartford, Conn.

[22] Filed: Dec. 15, 1975

[21] Appl. No.: 640,808

[52] U.S. Cl. ..... 416/97 R; 416/190; 416/218; 416/241 B

[51] Int. Cl.[2] ..... F01D 5/18

[58] Field of Search ..... 416/95–97, 416/241 B, 218, 190, 191, 221

[56] References Cited

UNITED STATES PATENTS

| | | | |
|---|---|---|---|
| 2,369,795 | 2/1945 | Planiol | 416/241 B X |
| 2,479,057 | 8/1949 | Bodger | 416/241 B X |
| 2,873,947 | 2/1959 | Perry | 416/241 B X |
| 2,951,340 | 9/1960 | Howald | 416/95 |
| 3,042,366 | 7/1962 | Holmquist | 416/95 |
| 3,271,004 | 9/1966 | Smuland | 416/91 X |
| 3,443,792 | 5/1969 | Moss | 416/241 B X |
| 3,741,681 | 6/1973 | De Witt | 416/95 |
| 3,814,539 | 6/1974 | Klompas | 416/95 |
| 3,841,792 | 10/1974 | Amos | 416/221 X |
| 3,857,650 | 12/1974 | Cerrato | 416/218 |

FOREIGN PATENTS OR APPLICATIONS

| | | | |
|---|---|---|---|
| 55,020 | 6/1951 | France | 416/241 B |
| 57,426 | 1/1953 | France | 416/241 B |

*Primary Examiner*—Everette A. Powell, Jr.
*Attorney, Agent, or Firm*—Charles A. Warren

[57] ABSTRACT

A turbine rotor construction in which the disk has radially extending tubes on which ceramic blades are slidable, and the centrifugal load on the blades is carried by an external filament wound ring surrounding and engaging the outer ends of the row of blades.

12 Claims, 3 Drawing Figures

TURBINE ROTOR CONSTRUCTION

SUMMARY OF THE INVENTION

The principal feature of the invention is a turbine rotor construction in which ceramic blades are radially slidable on torque transmitting tubes carried by and extending radially from the rotor disk, with a filament wound restraining ring positioned around the row of blades and engaging the outer ends thereof to carry the centrifugal load. The result is a lighter weight disk since it does not carry this load. The structure also makes possible the effective use of ceramics for the blade elements for use at higher temperatures, this being possible since they are loaded in compression. The invention also contemplates a spring ring on the disk to hold the row of blades against the restraining ring.

Another feature is the cooling of the blade support tube and the delivery of cooling air through the tube for cooling the outer end of the blade structure and thus the filament wound support ring in engagement therewith.

The foregoing and other objects, features, and advantages of the present will become more apparent in the light of the following detailed description of preferred embodiments thereof as illustrated in the accompanying drawing.

DESCRIPTION OF THE PREFERRED EMBODIMENT

Figure 1:
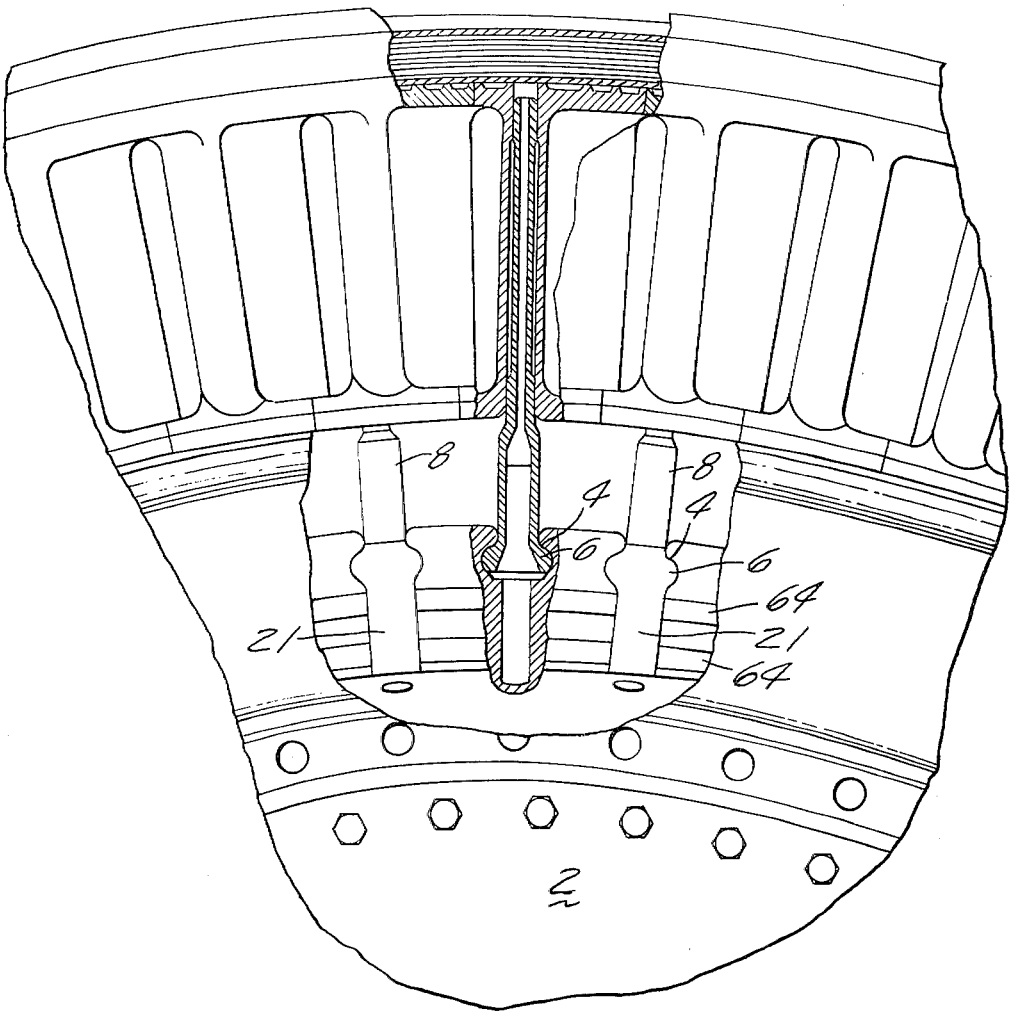
FIG. 1 is a side elevation of a portion of a turbine rotor with parts broken away.

As shown, the rotor includes a disk 2 having a plurality of slots 4 in its periphery to receive the roots 6 of the blade support tubes or posts 8. The disk also has radially extending cooling passages 10, the inner end being located in an axially extending surface 12 on the rotor and the passage terminating at its outer end in the base of each root slot 4. The disk 2 also has an axially extending rib 14 radially inward of the surface 12 for a purpose that will appear.

Figure 3:
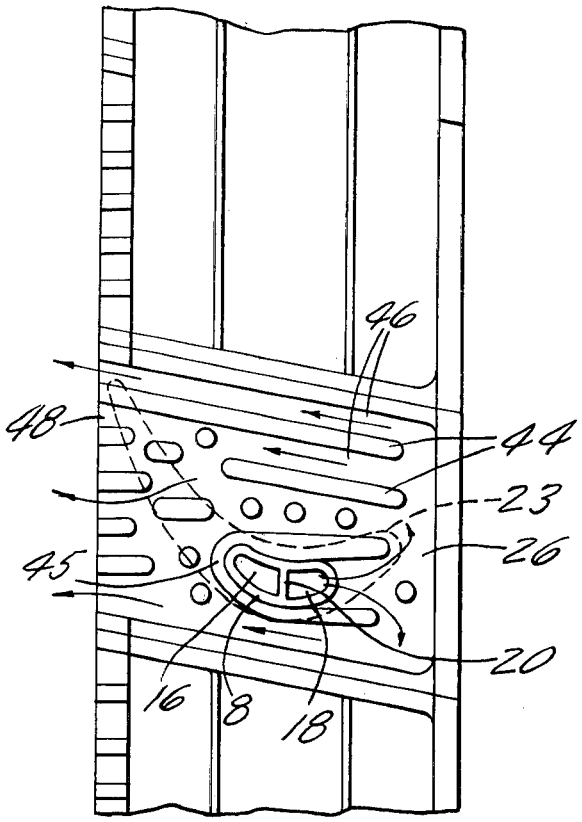
FIG. 3 is a view in the direction of the arrow 3 of FIG. 2 with parts broken away.

Each tube or post 8 is hollow as shown in FIG. 3, and preferably has two passages 16 and 18 divided by a central strut 20. The post 8 also has a flange 21 extending inwardly over one surface of the disk to prevent axial movement of the post with respect to the disk.

This tube or post is non-circular, preferably approximately airfoil in shape, with a truncated trailing edge as shown. This tube fits in a similarly shaped passage 22 extending through the blade 23, the latter being airfoil in external shape between the inner and outer shrouds 24 and 26 at opposite ends. These shrouds are preferably parallelogram-shaped and the outer shroud has outwardly extending edge ribs 28 and 30.

Extending around the outer ends of the row of blades is a filament wound restraining ring 32 to carry the centrifugal load on the blades. This ring is essentially an inert gas filled box-like structure 34 in which are positioned a multiplicity of windings 36 of a high strength fiber such as carbon fibers that may be embedded in a suitable matrix. The box may have several axially aligned compartments 38 and an outer closure ring 40. On the outer surface of the closure ring 40 may be formed one or more sealing flanges 42.

This retaining ring 32 is of a dimension to fit between the edge ribs 28 and 30 on the outer shroud for axial location of the ring. The outer surface of the outer shroud on each blade has spaced ribs 44 and 45 that define between them passages 46 for cooling air passing through the tubes and discharging into the spaces defined by these ribs between the outer shroud surface and the ring. The rib 45 is U-shaped as shown so that the cooling air is from the support post guided forwardly and then rearwardly in circuitous paths as shown by the arrows, FIG. 3. The cooling air discharges at the trailing edge of the shroud through notches 48 in the edge rib 28.

The posts 8 preferably have a bearing surface 50 adjacent the tip for engagement with the surrounding blade and a spaced bearing surface 52 adjacent the base of the blade, the surface 52 having a larger cross-sectional dimension than surface 50. Between these surfaces the tube is relieved as shown at 53. The posts are of such a length that they terminate short of the inner surface of the retaining ring as shown. The blade has cooperating bearing surfaces 54 and 55.

The blades are resiliently held outwardly against the restraining ring by a spring ring 56 suitably attached to the side of the disk and located thereon by the rib 14. As shown a resilient portion 58 of the ring urges the periphery 59 of the ring against the undersides of the inner shrouds on the blades. This spring action is desirably only enough to hold the blades in position thereby to keep to a minimum the loading on the restraining ring and to keep all the blades in the outermost position when the rotor is not turning. Suitable bolts 60 hold the ring in place.

Since the inlets to the cooling passages are located outwardly of the rib 14, the ring 56 defines with the disk an annular chamber 62 to which cooling air is supplied through passages 63 in the ring 56. This chamber communicates with the inlets to all the cooling passages in the disk.

Figure 2:
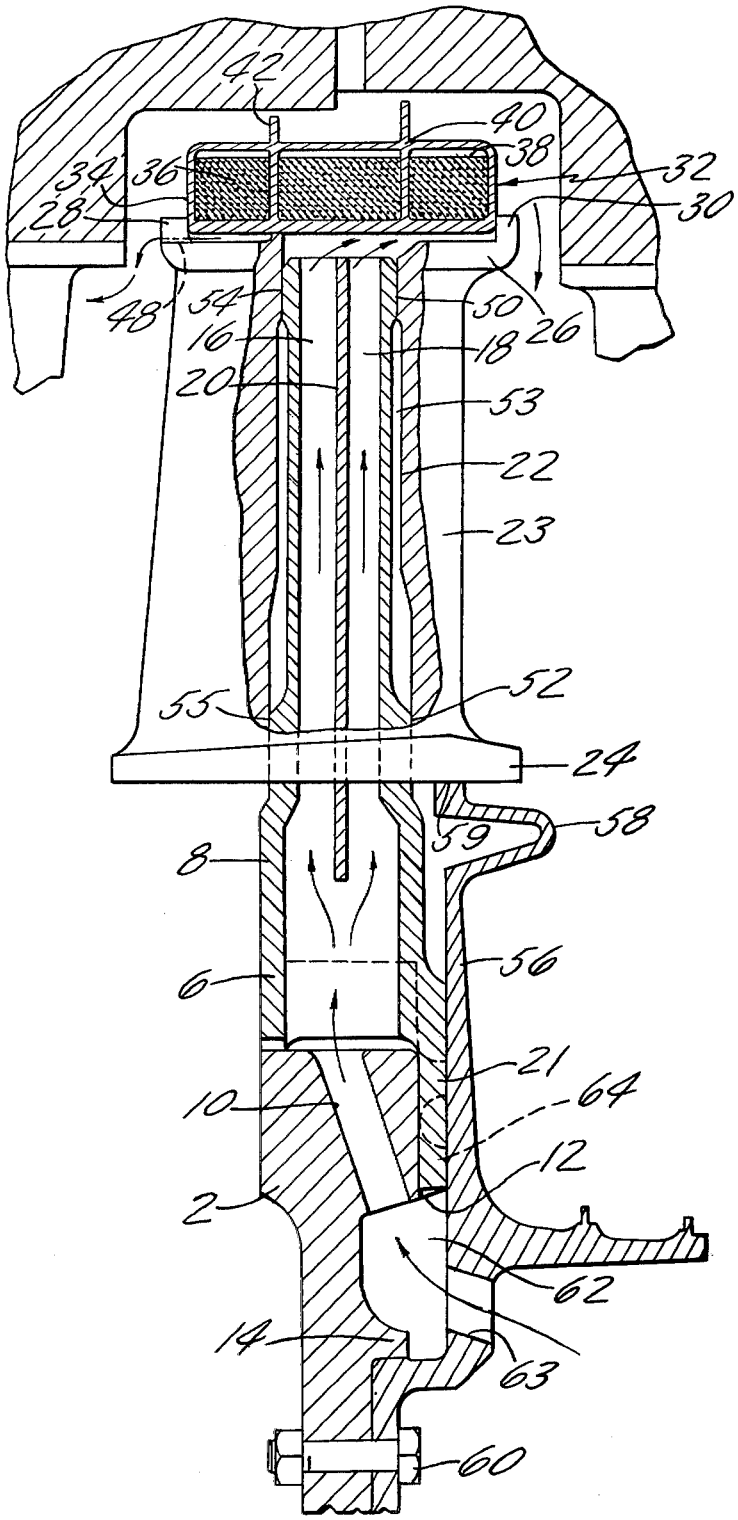
FIG. 2 is a transverse sectional view through the rotor.

The surface of the disk, outwardly of the chamber, may have one or more interrupted annular ribs 64 thereon, to engage with the side surface of the spring ring as shown in FIG. 2. This prevents loss of cooling air past the ring. These ribs extend between and engage the side edges of the flanges 21 on adjacent posts. These ribs in engagement with these flanges 21 assure the desired radial location of the several posts.

Since the spacing ring holds the blades against the filament wound ring at all times, the rotor will be in balance even when the rotor is at rest. When rotating, the blades, being unrestrained radially be the post are held in position thereon by the restraining ring which carries the centrifugal load on the blades. Thus the blades are loaded in compression in which ceramic blades are much stronger than in tension. Being ceramic the blades can withstand higher temperatures than metallic blades so the turbine may operate at higher temperatures. The cooling air flow maintains the posts at operable temperatures and also keeps the restraining ring within operable temperatures. The posts are restrained from axial movement relative to the disk by the flanges 21 clamped by the spring ring and the desired radial position of the posts is maintained by the ribs 64 engaging the flanges 21. The position of the spring ring is such as to overlie the slots in the disk periphery and limit the leakage of gases through these slots.

Although the invention has been shown and described with respect to a perferred embodiment thereof, it should be understood by those skilled in the art that other various changes and omissions in the form and detail thereof may be made therein without departing from the spirit and the scope of the invention.

Having thus described a typical embodiment of my invention that which I claim as new and desire to secure by Letters Patent of the United States is:

1. A turbine rotor construction including:

a disk having blade slots in the periphery;

blade positioning tubes having roots fitting in said slots and extending radially outward therefrom;

ceramic blades positioned on said tubes and radially slidable thereon, the outer end of the blade extending radially beyond the tube;

a filament wound ring surrounding said blades and engageable with the outer ends thereof, the ring being out of contact with the ends of the tubes; and a spring ring mounted on the disk and engaging the inner ends of the blades to hold the blades against the ring.

2. A rotor construction as in claim 1 in which the tube is hollow for the flow of cooling air to the outer end of the ceramic blade.

3. A rotor construction as in claim 2 in which the outer end of each blade has ribs thereon to define flow passages for the cooling air from the blades.

4. A rotor construction as in claim 1 in which the outer end of each blade has a shroud element with the shroud elements on adjacent blades substantially in circumferential engagement.

5. A rotor construction as in claim 1 in which said spring ring extends over the blade slots to reduce flow losses through the slots.

6. A rotor construction as in claim 1 in which the tube is non-cylindrical and blade has similar shaped cooperating passage so that tube prevents turning of blade on its radial axis.

7. A turbine rotor assembly including:

a disk having axial slots in its periphery;

blade positioning posts having inner end roots engaging said slots and extending radially outward therefrom;

ceramic blades positioned on said posts and radially slidable thereon, the outer ends of the blades being radially outward of the ends of the posts, said blades having outer end shrouds;

a filament wound restraining ring surrounding said blades and engaging the outer end shrouds to position the blades on the posts;

a spring ring mounted on the disk and engaging the inner ends of the blades to hold them against the retaining ring; and means for supplying coolant through said posts to said outer shrouds.

8. An assembly as in claim 7 wherein the posts are non-cylindrical and the blades have correspondingly shaped passages to accept the posts.

9. An assembly as in claim 7 in which the disk has coolant passages communicating with slots, and the posts have longitudinal passages to deliver coolant therethrough to the outer shrouds.

10. An assembly as in claim 7 in which the outer shrouds have ribs on the outer surfaces to engage with the restraining ring and define coolant passages between the shroud and ring.

11. An assembly as in claim 10 in which each post has a flange extending inwardly from the root and overlying the disk to be engaged by the spring ring.

12. An assembly as in claim 11 in which the disk has interrupted annular ribs thereon engaging the post flanges to hold the posts in position.

* * * * *